US011560290B2

(12) United States Patent
Lodi

(10) Patent No.: US 11,560,290 B2
(45) Date of Patent: Jan. 24, 2023

(54) CARRIAGE AND A SLIDING SUPPORT APPARATUS FOR A STAIRLIFT

(71) Applicant: EXTREMA S.R.L., Bagnolo San Vito (IT)

(72) Inventor: Federico Lodi, Fabbrico (IT)

(73) Assignee: EXTREMA S.R.L., Bagnolo San Vito (IT)

( * ) Notice: Subject to any disclaimer, the term of this patent is extended or adjusted under 35 U.S.C. 154(b) by 304 days.

(21) Appl. No.: 16/756,318

(22) PCT Filed: Oct. 16, 2018

(86) PCT No.: PCT/IB2018/057995
§ 371 (c)(1),
(2) Date: Apr. 15, 2020

(87) PCT Pub. No.: WO2019/077479
PCT Pub. Date: Apr. 25, 2019

(65) Prior Publication Data

US 2020/0239282 A1 Jul. 30, 2020

(30) Foreign Application Priority Data

Oct. 17, 2017 (IT) ..... 102017000117273

(51) Int. Cl.
*B66B 9/08* (2006.01)

(52) U.S. Cl.
CPC ..... *B66B 9/08* (2013.01); *B66B 9/0815* (2013.01); *B66B 9/0846* (2013.01)

(58) Field of Classification Search
CPC ..... B66B 9/08; B66B 9/0815; B66B 9/0846
See application file for complete search history.

(56) References Cited

U.S. PATENT DOCUMENTS 3,087,583 A * 4/1963 Bruns ..... B66B 7/048 267/169
6,082,496 A * 7/2000 Bovis ..... B66B 9/0815 187/200

(Continued)

FOREIGN PATENT DOCUMENTS

JP 2014129171 7/2014
WO 2005085116 9/2005

(Continued)

OTHER PUBLICATIONS

JP2014129171—Machine Translation (Year: 2014).*

*Primary Examiner* — Michael A Riegelman
(74) *Attorney, Agent, or Firm* — Pearne & Gordon LLP

(57) ABSTRACT

A carriage (1) for a stairlift is configured for sliding along a support guide (2). The carriage (1) comprises a concave shaped frame (101), defining a seat (S) for housing at least a part of said guide (2); at least one upper roller (102), mounted on an upper portion of said frame (101) to be rotatably engageable resting on an upper surface of a head portion (201) of the guide (2); a rolling member (103), mounted on a lower portion of the frame (101) to be rotatably engageable with a lower surface of a base portion (203) of the guide (2); and first and second lower rollers (104*a*, 104*b*), mounted on the frame (101) in the proximity of the rolling member (103) in such a way as to be engaged or can be engaged in rolling movement respectively on a first lateral surface (203*a*) and a second lateral surface (203*b*) of the base portion (203) of the guide (2).

24 Claims, 9 Drawing Sheets

(56) References Cited

U.S. PATENT DOCUMENTS

| | | | | |
|---|---|---|---|---|
| 6,755,136 | B2 * | 6/2004 | Jenkins | B66B 9/0815 105/141 |
| 6,758,325 | B2 * | 7/2004 | Greeley | B65G 9/008 198/465.4 |
| 2003/0029352 | A1 * | 2/2003 | Jenkins | B66B 9/0815 105/144 |
| 2004/0104078 | A1 * | 6/2004 | Szentistvany | B66B 9/0846 187/245 |
| 2006/0027445 | A1 * | 2/2006 | Szentistvany | B66B 9/0846 198/860.1 |
| 2012/0048652 | A1 * | 3/2012 | DiGiovanni | B66B 9/0815 187/201 |
| 2014/0083801 | A1 * | 3/2014 | Vroegindeweij | B66B 9/0815 187/201 |
| 2014/0151157 | A1 * | 6/2014 | Hall | B66B 9/0807 187/202 |
| 2016/0236906 | A1 * | 8/2016 | Horton | B66B 9/0846 |
| 2017/0233223 | A1 * | 8/2017 | Hoedjes | B66B 9/0815 187/201 |
| 2017/0247227 | A1 * | 8/2017 | Rosenthal | B66B 9/0838 |
| 2020/0239282 | A1 * | 7/2020 | Lodi | B66B 9/0815 |
| 2020/0277161 | A1 * | 9/2020 | Lodi | B66B 5/22 |
| 2021/0087019 | A1 * | 3/2021 | Chida | B66B 9/0815 |
| 2022/0081256 | A1 * | 3/2022 | Brook | B66B 9/0815 |
| 2022/0081257 | A1 * | 3/2022 | Brook | B66B 9/0846 |

FOREIGN PATENT DOCUMENTS

| | | | | |
|---|---|---|---|---|
| WO | WO-2020243410 | A1 * | 12/2020 | B66B 9/0815 |
| WO | WO-2022003332 | A1 * | 1/2022 | B66B 9/0815 |

* cited by examiner

CARRIAGE AND A SLIDING SUPPORT APPARATUS FOR A STAIRLIFT

This invention relates to the technical field of stairlift systems for use by persons with reduced mobility.

More specifically, the invention relates to a carriage for a stairlift, a sliding support apparatus for a stairlift, comprising the above-mentioned carriage, a stairlift and a relative assembly kit.

A stairlift is a system for use by persons with reduced mobility, configured to move a loading element, such as a seat, a chair, or a platform for wheelchairs, along an inclined plane. Stairlifts are used to overcome architectural barriers in existing buildings, linked, for example, to the presence of a stairway or a ramp.

The prior art stairlifts comprise the above-mentioned loading element, one or more carriages connected to the loading element and one or more guides on which the above-mentioned carriages are slidably installed.

The prior art stairlifts differ in systems with lateral guides and systems with ceiling guides, depending on the position of the guides.

In the stairlifts with lateral guides there are usually two guides connected to a wall or to a lateral support element and respective carriages connected to the loading element.

The prior art stairlifts with lateral guides have the drawback of not being able to deal with sharp curves on the side opposite in which the guide is installed, due to the overall size of the loading element which would risk striking against the guide. In order to overcome this drawback, the installation of the guide on the side of the path which has the greatest number of sharp curves is known, maintaining sufficiently high the radius of curvature in the case of curves in the opposite direction.

The prior art stairlifts are further divided into stairlifts with a fixed motor, which moves the loading element along the guides by means of a system of cables, and stairlifts with a motor movable in an integral fashion with the loading element. The latter systems usually have a rolling member which, by gripping on one of the guides, moves the loading element. Systems of this type usually comprise a pinion meshed in a rack positioned along a guide.

Normally, in the prior art stairlifts with a lateral guide the rack is installed on a lower side of the lower guide and the pinion is installed on a lower portion of the corresponding lower carriage. This arrangement is motivated by the need to reduce the risk of accidents linked to the dangerousness of the pinion-rack meshing in motion.

The prior art stairlifts also comprise, necessarily, a braking unit, for stopping the stairlift in the event of malfunctions and preventing dangerous uncontrolled descents. The braking unit normally acts between the upper carriage and the upper guide, left free by the motor-pinion-rack unit mentioned above.

One of the problems relating to the stairlifts with pinion-rack meshing consists in maintaining the above-mentioned meshing at curved guide sections. In the case of lateral changes of direction along a sloping path, as often occurs along the path of a stairway, the guides perform a helical curve. In the event of slope change, for example to follow a landing, the guides have a flat curvature. In both cases the pinion-rack meshing is disturbed.

Disadvantageously, the prior art comprises the production of stretches of guide and curved racks by bending-twisting of the rectilinear stretches. Disadvantageously, this leads to errors in meshing and penetration between the teeth of the pinion and of the rack.

The problem of the correct meshing of the pinion on the rack is further exacerbated by the instability of the carriages sliding along the guides. The prior art carriages have, in effect, a plurality of rollers located above and/or to the side of the guides, in such a way as to support the loading element and direct it along the guide. Disadvantageously, however, the arrangement of the rollers on the prior art carriages is not suitable to maintain a stable alignment of the pinion relative to the guide, in particular in the curved stretches described above.

A solution falling within the type described above is known from patent document WO2005/085116, which describes a carriage equipped with two groups of outer rollers (that is to say, front and rear along the guide) and a group of intermediate rollers, wherein the outer rollers fit around the upper part of the guide whilst the group of intermediate rollers comprises an upper roller and a lower roller, engaged on opposite sides of the guide. In this case, too, the geometry of the arrangement of the outer and intermediate rollers may cause problems of stability and misalignment of the carriage relative to the guide, in particular in the curved stretches and/or slope variation of the guide.

In order to attenuate the stability problems presented by the prior art, the rollers are made with a convex profile, shaped to adhere to the curved outer surface of the guide.

Moreover, the opposite lateral rollers are clamped against the guide in such a way as to reduce as much as possible the clearance between the carriage and the guide.

Disadvantageously, these measures determine the occurrence of forces and scraping between the rollers and the guide which accelerate the wear of the rollers and increase the sliding resistance of the carriage on the guide.

Moreover, in order to attenuate the meshing problems presented by the prior art in the curved portions of the guide, the racks are normally made with softer material than the pinion, in such a way that the teeth of the pinion can penetrate locally the teeth of the rack and adapt them to the different meshing.

Disadvantageously, this measure, although effective in the short term, leads to a rapid wear of the rack, with consequent problems of durability, maintenance costs, long-term safety, stability and comfort during use.

In this context, the technical purpose which forms the basis of this invention is to provide a carriage and a sliding support apparatus for a stairlift which overcomes at least some of the above-mentioned drawbacks of the prior art.

More specifically, the aim of the invention is to provide a carriage and a sliding support apparatus for a stairlift which is able to improve the durability of the rack, reduce maintenance costs and increase long-term safety.

Another aim of the invention is to provide a carriage and a sliding support apparatus for a stairlift which is able to increase the sliding stability of the carriage on the respective guide.

A further aim of the invention is to provide a carriage and a sliding support apparatus for a stairlift which is able to reduce the resistance to sliding of the carriage on the guide and at the same time reduce the wear of the components of the carriage.

According to one aspect, the invention relates to a carriage for a stairlift, configured to slide along a support guide of the type comprising a head portion, a base portion and a central portion comprised between the head portion and the base portion and configured for fixing to a lateral support element. The carriage comprises a concave shaped frame, defining a seat for housing at least a part of the guide; at least one upper roller, mounted on an upper portion of the frame to be rotatably engageable resting on an upper surface of a head portion of the guide; a rolling member, mounted on a lower portion of the frame to be rotatably engageable with a lower surface of a base portion of the guide; first and second lower rollers, mounted on the frame in the proximity of the rolling member in such a way that the first and second lower rollers are engaged or can be engaged in rolling movement respectively on a first lateral surface of the base portion and a second lateral surface of the base portion, opposite the first.

Preferably, the carriage comprises two upper rollers.

Preferably, the first lower rollers are mounted on the lower portion of the frame.

Preferably, the frame comprises a lateral portion for connecting between the upper portion and the lower portion.

Preferably, the lower second rollers are mounted on the lateral portion or on the lower portion.

Preferably, the first rollers lower and the lateral portion are positioned in opposite positions relative to the housing seat.

Preferably, the upper roller and the rolling member are mounted on the frame of the carriage in a rotatable fashion about axes of rotation which are parallel to each other.

Preferably, each of the first and/or second lower rollers is associated with an elastic element for connecting between the lower roller and the frame and a compliance of the elastic element determines a variation of inclination of the axis of rotation of the lower roller relative to the frame.

Preferably, only the first or alternatively the second lower rollers are associated with at least one elastic element.

Preferably, the first and/or second lower rollers have convex or curved lateral surfaces.

Preferably, only the first lower rollers have convex or curved lateral surfaces.

Preferably, the carriage comprises two first lower rollers and two second lower rollers wherein the first lower rollers are located at a distance from each other less than the distance between the second lower rollers.

Preferably, the lower rollers positioned on the side designed to face a lateral support element of the guide have a reciprocal distance less than the lower rollers positioned on the opposite side.

Preferably, the first lower rollers are located at a distance from each other less than the distance between the second lower rollers.

Preferably, the lower rollers are positioned in plan view at respective vertices of an isosceles trapezium.

Preferably, the first lower rollers are positioned at the vertices of a smaller base of the trapezium and the second lower rollers are positioned at the vertices of a large base of the trapezium.

Preferably, the lower rollers are positioned in plan view at respective vertices of the isosceles trapezium in such a way that the extensions of opposite oblique sides of the isosceles trapezium meet at a distance of between 20 cm and 30 cm from the first lower rollers.

Preferably, the distance is between 23 cm and 27 cm, even more preferably between 25 cm and 26 cm.

Preferably, the lower rollers referred to the same oblique side of the isosceles trapezium have a minimum distance from each other, in a plane perpendicular to an axis of the lower rollers, and the lower rollers are positioned in plan view at respective vertices of the isosceles trapezium in such a way that a ratio between the distance and the minimum distance is between 5 and 7.5, preferably between 6.25 and 6.5.

Preferably, the lower rollers are positioned in plan view at respective vertices of the isosceles trapezium in such a way that an angle formed between the extensions of opposite oblique sides of the trapezium is between 25° and 33°, preferably between 28° and 30°.

Preferably, the frame has a rigid configuration.

Preferably, the lower rollers are applied to portions of the frame rigidly connected to each other.

Preferably, the isosceles trapezium has a permanent shape.

According to an embodiment, the rolling member comprises a pinion which can be meshed with a rack applied beneath the guide.

According to an embodiment, the rolling member comprises a friction rotor, connected with a safety device which can be moved to engage with the guide in a safe condition stopping the sliding of the carriage.

Preferably, a vertical distance between each of the first and/or second lower rollers and the rolling member is less than 3 cm and preferably between 1 and 2 cm.

According to another aspect, the invention relates to a sliding support apparatus for a stairlift, which comprises a support guide and a carriage slidably movable on the guide, the guide comprising: a head portion, a base portion, a central portion positioned between the head portion and the base portion and configured for anchoring to a lateral support element; wherein the upper roller of the carriage is engaged in rolling motion on an upper surface of the head portion of the guide; wherein the rolling member of the carriage is engaged in rolling motion with a lower surface of the base portion of the guide, and wherein the first and second lower rollers of the carriage are engaged or can be engaged in rolling motion on a respective first and second lateral surface, opposite each other, of the base portion of the guide.

Preferably, the central portion of the guide comprises an engagement seat interposed between the head portion and the base portion and suitably shaped in such a way as to receive one or more fixing elements designed to fix the guide to a lateral support element.

Preferably, the central portion of the guide comprises an engagement seat interposed between the head portion and the base portion and suitably shaped in such a way as to receive one or more fixing elements designed to fix the guide to a lateral support element, the first lower rollers of the carriage are configured to be arranged in a position lower vertically than the fixing elements.

Preferably, one between the first and second lateral surfaces of the base portion of the guide is convex and engaged with corresponding lower cylindrical rollers and/or the other between first and the second lateral surface of the base portion of the guide is planar and engaged with corresponding convex or rounded lower rollers.

Preferably, the guide is modular and realised by means of a junction of prefabricated and preconfigured elements, and the elements comprise rectilinear sections and curved sections, connected to each other to define a guide extending along a desired trajectory.

According to an embodiment, the base portion of the guide comprises a rack, the rolling member comprises a pinion meshed with the rack and apparatus can be moved along the guide by means of a motor mounted on it which drives the pinion.

According to an alternative embodiment, the rolling member comprises a friction rotor engaged in rolling motion with the guide, connected with a safety device which can be moved to engage with the guide in a safe condition stopping the sliding of the carriage and the apparatus comprises a braking unit which can be operated by the friction rotor.

According to another aspect, the invention relates to a stairlift which comprises a loading element; a first sliding support apparatus, wherein the respective carriage is connected to a first portion of the loading element; and a second sliding support apparatus wherein the respective carriage is connected to a second portion of the loading element.

According to another aspect, the invention relates to a kit for making a stairlift which comprises a loading element; a first support apparatus connected or connectable to a first portion of the loading element; a second support apparatus, connected or connectable to a second portion of the loading element; wherein the guides of the first and second sliding support apparatus are modular and comprise a plurality of modules connectable to each other.

Preferably, the plurality of modules comprises: at least one rectilinear module, which has zero curvature, at least one inclination change module, provided in the pre-curved configuration according to a predetermined radius of curvature, at least one spiral coiled module, provided in the pre-curved configuration along a spiral radius of curvature which is constant and predetermined.

Preferably, the rectilinear stretches of the rack are meshed or can be meshed on the pinion from the side of the first lower rollers.

Preferably, in the rectilinear stretches, the rack is positioned at a distance from the edge of the pinion of less than 12 mm, preferably between 3 mm and 9 mm, even more preferably between 5 mm and 7 mm.

Preferably, the rack has helical curve portions in which the chordal thickness of teeth of the rack is less than the chordal thickness of teeth of the rack in the rectilinear portions.

Preferably, the rack has slope change portions wherein the teeth are corrected for a meshing of the type pinion-gear meshing. Even more preferably, in the slope change portions of the rack the shape of the teeth is involute.

Preferably, the guides of the first and second sliding support apparatus are modular and comprise a plurality of modules connectable to each other.

Further features and advantages of the invention are more apparent in the non-limiting description which follows of a preferred embodiment.

The description is set out below with reference to the accompanying drawings which are provided solely for purposes of illustration without restricting the scope of the invention and in which.

Figure 1:
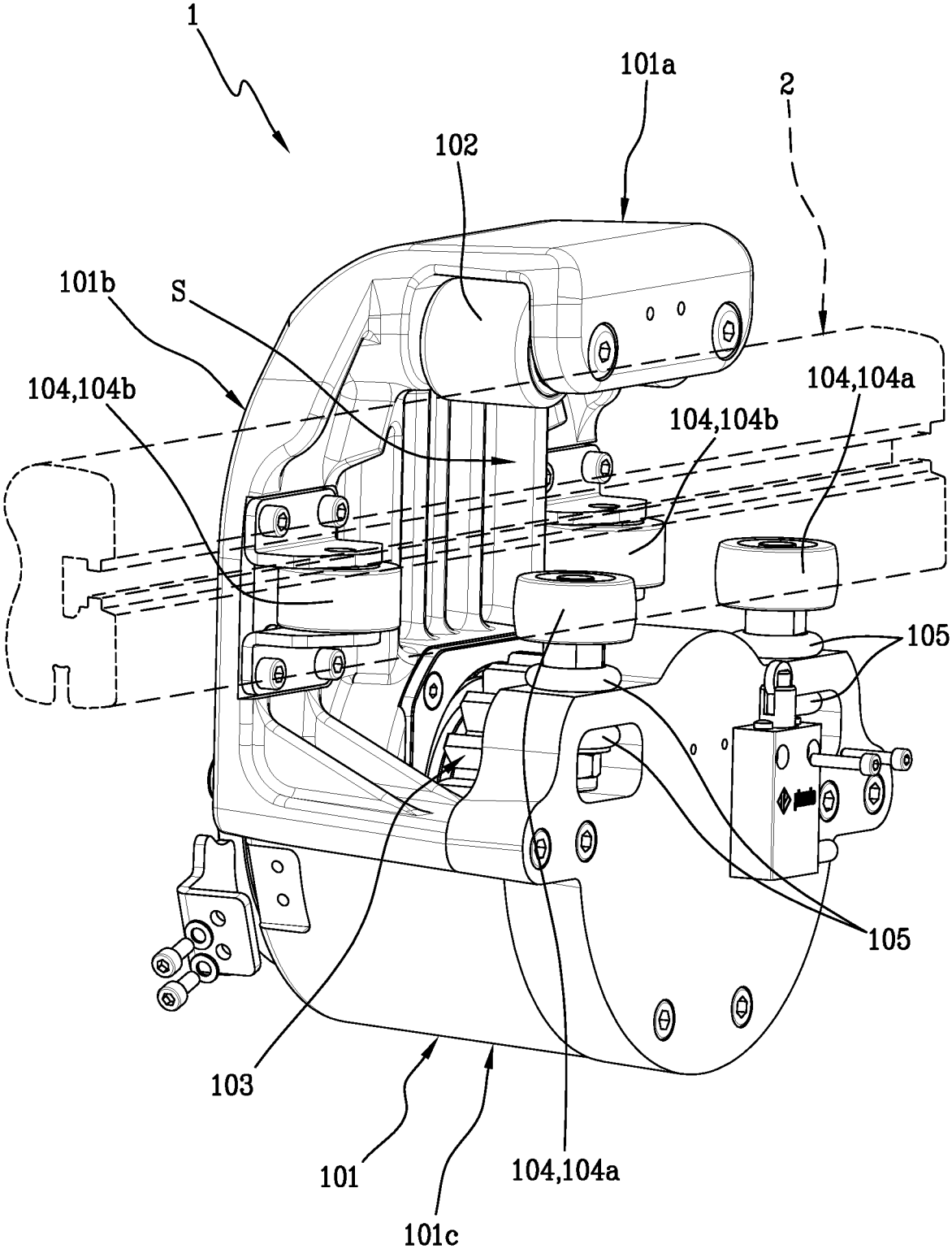
FIG. 1 is a perspective view of carriage for a stairlift, made in accordance with the present invention.
Figure 2:
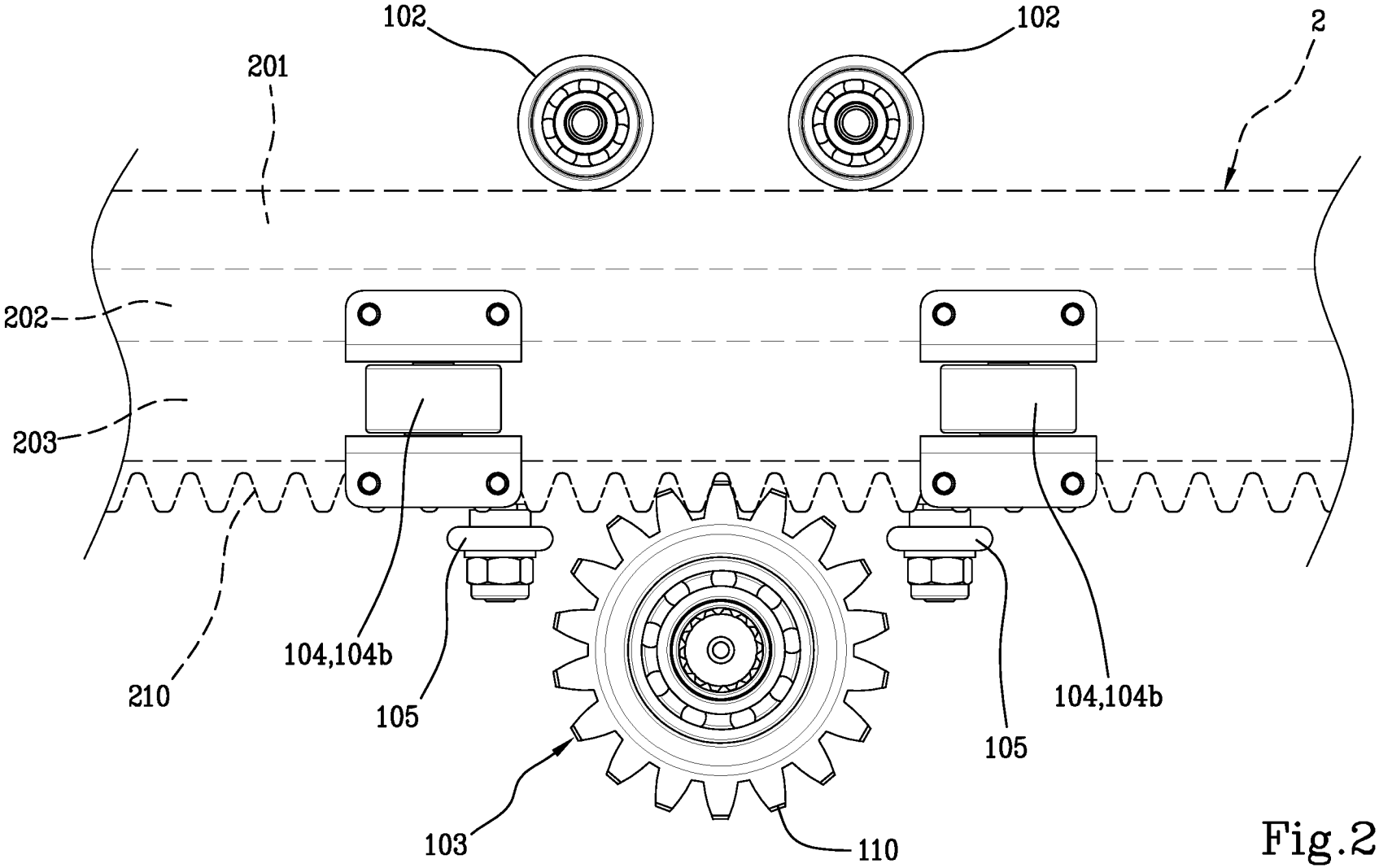
FIG. 2 shows in detail a side view of some components of the carriage of FIG. 1.

With reference to the drawings, numeral 1 generically indicates a carriage for a stairlift, connected or connectable to a loading element 15, in particular a seat, a chair, or a platform for wheelchairs.

The carriage 1 is configured to slide along a support guide 2, drawn with a solid line in FIGS. 5 to 8 and with a dashed line in FIGS. 1 to 4. The guide 2 comprises a head portion 201, a central portion 202 and a base portion 203.

The central portion 202 is between the head portion 201 and the base portion 203 and is configured for fixing to a lateral support element, such as a wall or a rail suitably reinforced. More specifically, the central portion 202 of the guide 2 comprises an engagement seat 207, suitably shaped to receive fixing elements (not illustrated) designed to fix the guide 2 to a lateral support element.

Preferably, the central portion 202 forms a narrowing of the guide 2 between the head portion 201 and the base portion 203.

The carriage 1, the guide 2 and the fixing elements are designed to support, at least partly, the weight of the loading element 15 and any passengers and to discharge the above-mentioned weight onto the lateral support element.

The carriage 1 comprises a frame 101, at least one upper roller 102, at least one rolling member 103 and a plurality of lower rollers 104, in particular first lower rollers 104*a* and second lower rollers 104*b*.

The frame 101 has a concave shape which defines a seat "S" for housing the guide 2. More specifically, the housing seat "S" is defined at above, below and on a side by the concave profile of the frame 101, whilst the other side is free at the engagement seat 207. This configuration of the frame 101, open on the side of the guide 2 designed for fixing to a lateral support element, allows the frame 101 to move along the guide 2 without intercepting the fixing elements of the guide 2 to the lateral support element.

More in detail, the frame 101 has an upper portion 101*a* which defines above the housing seat "S", a lower portion 101*c* which defines below the housing seat "S" and a lateral portion 101*b*, interposed between the upper portions 101*a* and lower portions 101*c* to connect them to each other, which defines the side of the housing seat "S" opposite the free side.

Preferably, the carriage 1 comprises at least two upper rollers 102, in particular exactly two. The upper rollers 102 are mounted on the upper portion 101*a* of the frame 101 to be rotatably engageable resting on an upper surface of the head portion 201 of the guide 2. The upper rollers 102 are configured for transmitting the vertical loads between the loading element 15 and the guide 2 and to support, at least partly, the weight of the loading element 15 and any passengers. Preferably, the upper rollers 102 are fixed to the frame 101 by bearings.

The rolling member 103 is mounted on a lower portion 101*c* of the frame 101 to be rotatably engageable with a lower surface of the base portion 203 of the guide 2, preferably in a vertical position opposite the upper rollers 102.

Preferably, the upper rollers 102 and the rolling member 103 are mounted on the frame 101 of the carriage 1 in a rotatable fashion about axes of rotation parallel to each other.

In a first embodiment of the carriage 1, illustrated in the drawings, the rolling member 103 comprises a pinion 110 which can be meshed with a rack 210 applied beneath the guide 2. Preferably, the carriage 1 also comprises a motor, configured to rotate the pinion 110 and move the loading element 15 connected to the carriage 1.

In a second embodiment of the carriage 1, not illustrated and as an alternative to the first embodiment, the rolling member 103 comprises a friction rotor 111, connected to a safety device 5, to cause a movement of the safety device 5 in a safety condition configured to stop the sliding of the carriage 1 on the guide 2. More specifically, the friction rotor 103 is rotatably engageable with an insert installed or which can be installed below the base portion 203 of the guide 2, in place of the rack 210 present in the first embodiment.

The first and second lower rollers 104*a* and 104*b* are mounted on the frame 101 in such a way that, in the configuration of use, they are positioned at respective opposite sides of the guide 2. More specifically, the first lower rollers 104*a* are positioned on the carriage 1 in such a way as to engage in rolling motion on a first lateral surface 203*a* of the base portion 203 of the guide 2 positioned towards the lateral support element. Preferably, the first lateral surface 203*a* is located on the side of the guide 2 which has the engagement seat 207.

Preferably, the first and the second lower rollers 104*a* and 104*b* are mounted on the lateral portion 101*b* and/or lower portion 101*c* of the frame 101.

More specifically, the first lower rollers 104*a* and the lateral portion 101*b* are positioned in opposite positions relative to the housing seat "S".

Preferably, the first lower rollers 104*a* are mounted on the lower portion 101*c* of the frame 101 in such a way to be positioned beneath the fixing elements of the guide 2 and to slide below them during a movement of the carriage 1 along the guide 2.

Preferably, the second lower rollers 104*b* are mounted directly on the lateral portion 101*b*.

In at least one embodiment, the second lower rollers 104*b* are positioned on the carriage 1 in such a way as to engage in rolling motion on a second lateral surface 203*b* of the base portion 203 of the guide 2, opposite the first surface. In the embodiment illustrated, the second lateral surface 203*b* is positioned on the side of the guide 2 which does not have the engagement seat 207. More specifically, the second lower rollers 104*b* are located on the side of the frame 101 (and, in use, of the guide 2) positioned on the side of the loading element 15.

Preferably, the axis of rotation of the first and second lower rollers 104*a* and 104*b* is perpendicular relative to the axis of rotation of the upper rollers 102 and of the rolling member 103.

In the embodiment illustrated, the carriage 1 comprises two first lower rollers 104*a* and the two second lower rollers 104*b*.

The first rollers lower 104*a* are connected to the frame 101 exclusively at its lower part, preferably by means of a pin protruding upwards from the lower portion 101*c* of the frame 101.

Preferably, the second lower rollers 104*b* are connected to the frame 101 by a through pin fixed or connected to the lateral portion 101*b* or lower portion 101*c* of the frame 101 above and below the respective second lower roller 104*b*.

Advantageously, the first and the second lower rollers 104*a* and 104*b* are installed in the proximity of the rolling member 103. In the embodiment illustrated, the first and the lower second rollers 104*a* and 104*b* are installed in such a way as to have a vertical distance of less than 3 cm between its lower end and an upper end of the rolling member 103. Preferably, the above mentioned vertical distance is between 1 cm and 2 cm.

Preferably, each first and/or second lower roller 104 is associated with at least one elastic element 105 for connecting between the roller 104 and the frame 101, preferably made of polymeric or elastomeric material. In the embodiment illustrated in FIGS. 1 to 8, only each first lower roller 104*b* is associated with at least one elastic element 105. In alternative embodiments, not illustrated, only each second lower roller 104*a* is associated with at least one elastic element 105.

Figure 7A:
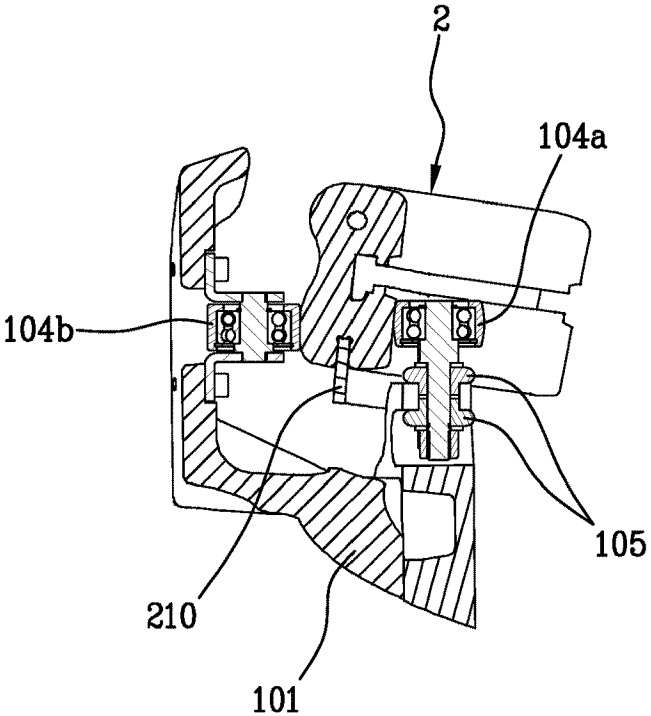
FIG. 7A shows a cross section of the apparatus of FIG. 7 according to the line D-D.
Figure 7:
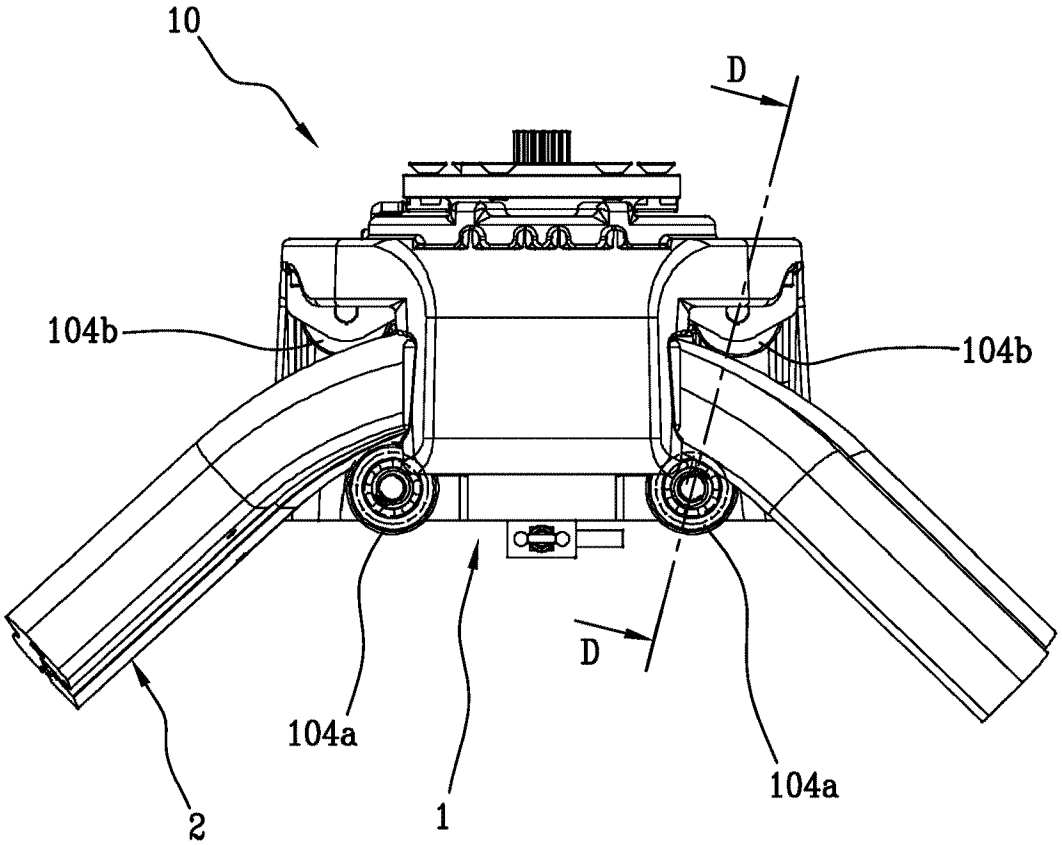
FIG. 7 is a top view of the apparatus of FIG. 6.
Figure 8:
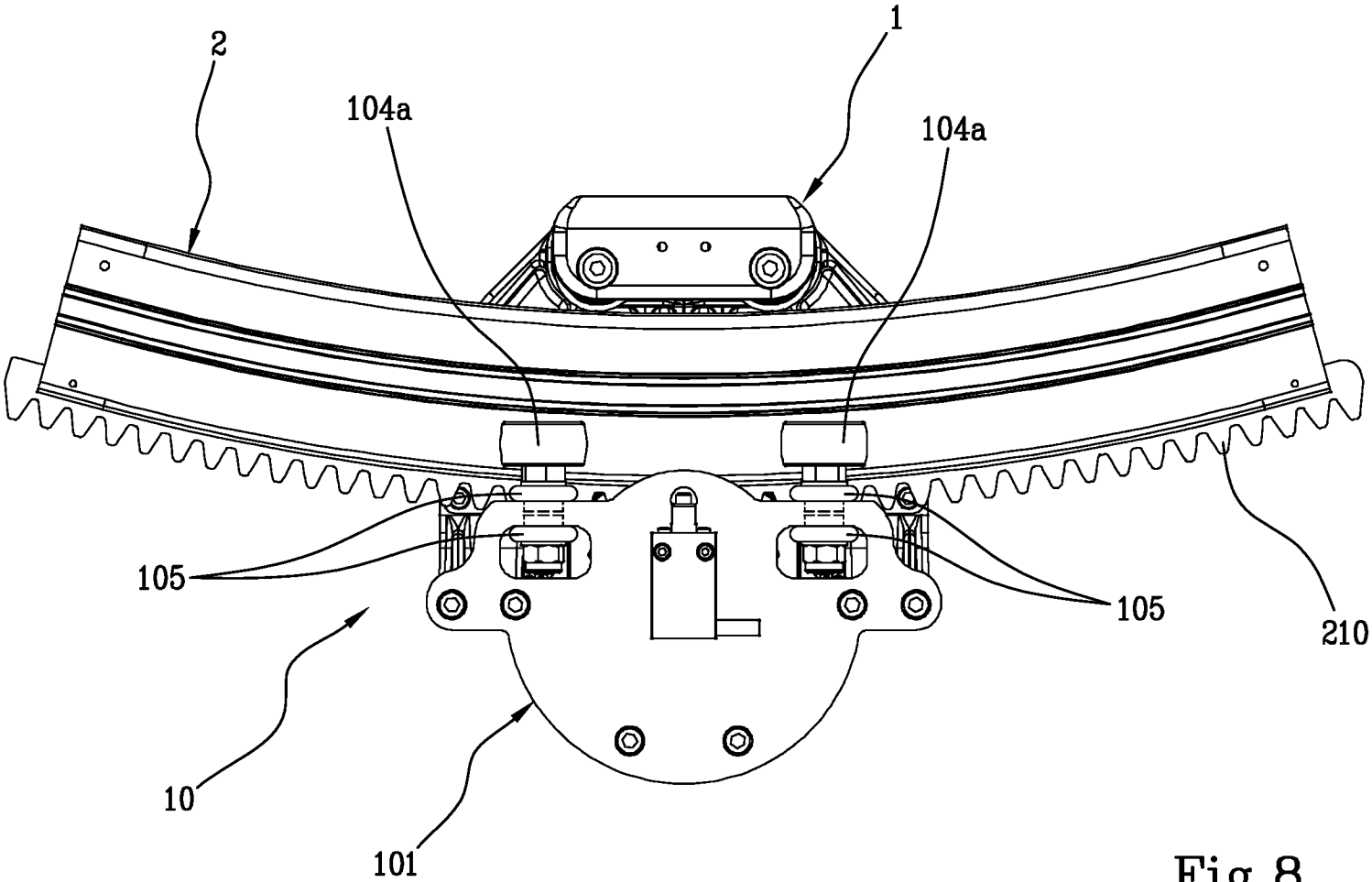
FIG. 8 is a side view of the machine of FIG. 5, in a different operating configuration.

Advantageously, a compliance of the elastic element 105 determines a variation of the inclination of the axis of rotation of the respective roller lower 104 relative to the frame 101. More specifically, the elastic elements 105 are configured to absorb any misalignments between the carriage 1 and the guide 2 at curved stretches of the guide 2 (FIG. 7A).

Preferably, in the first embodiment of the carriage 1, wherein the rolling member 103 comprises the pinion 110, the first lower rollers 104*a* are associated with respective elastic elements 105 whilst the second lower rollers 104*b* are mounted in a fixed fashion on the frame 101.

Preferably, in the second embodiment of the carriage 1, wherein the rolling member 103 comprises a friction rotor 111, the second lower rollers 104*a* are associated with respective elastic elements 105 whilst the first lower rollers 104*b* are mounted in a fixed fashion on the frame 101.

Preferably, the frame 101 has rigid configuration in such a way as to keep the mutual arrangement of the upper rollers 102, the rolling member 103 and the lower rollers 104, except for deformations of the elastic elements 105, in particular during travel along curved stretches of the guide 2.

Preferably, the first and/or second lower rollers 104 have a rounded profile and have convex lateral surfaces.

Preferably, only the first lower rollers 104*a* have convex lateral surfaces, whilst the second lower rollers 104*b* have a cylindrical shape.

Figure 3:
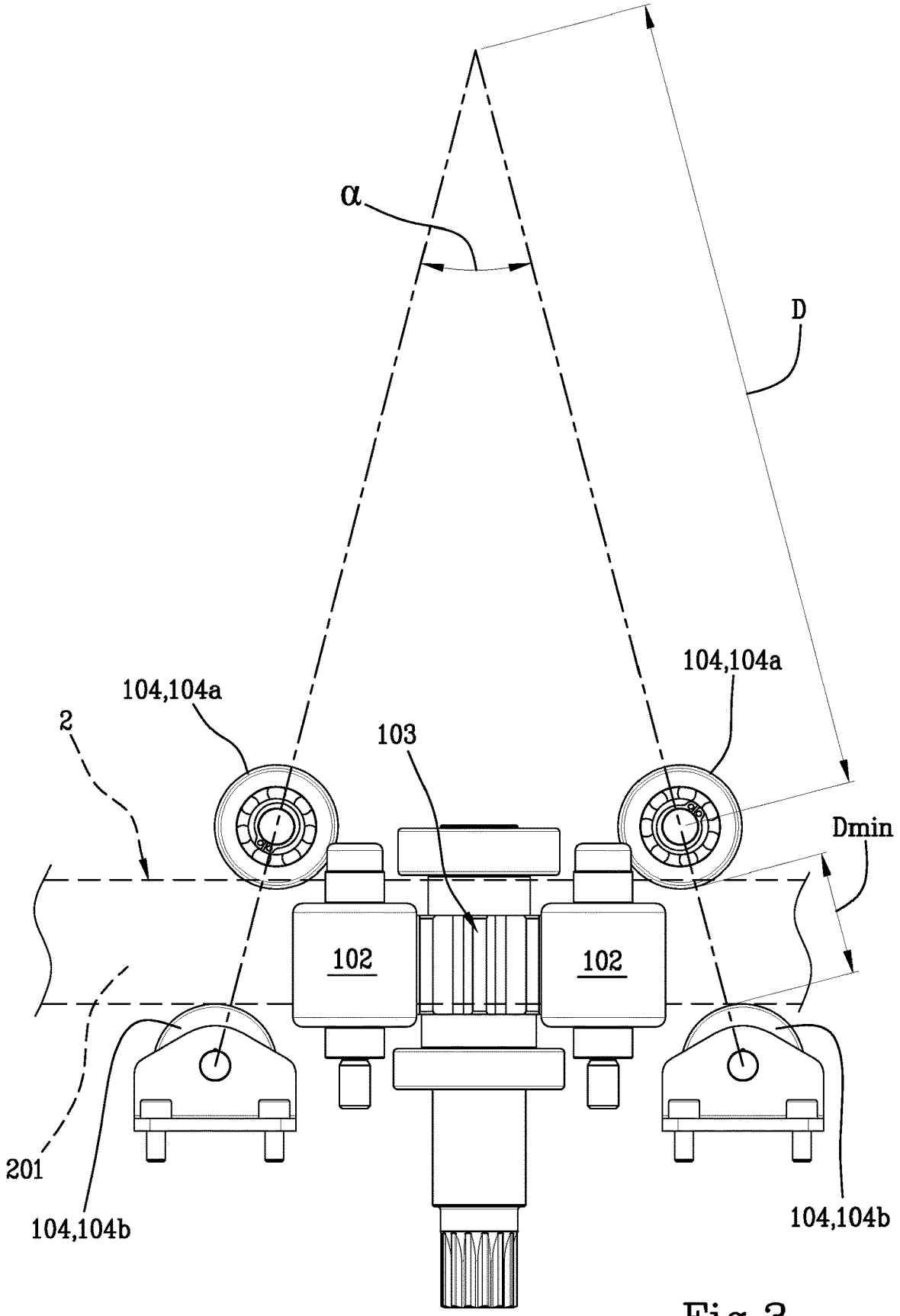
FIG. 3 is a top view of the components of FIG. 2.
Figure 6A:
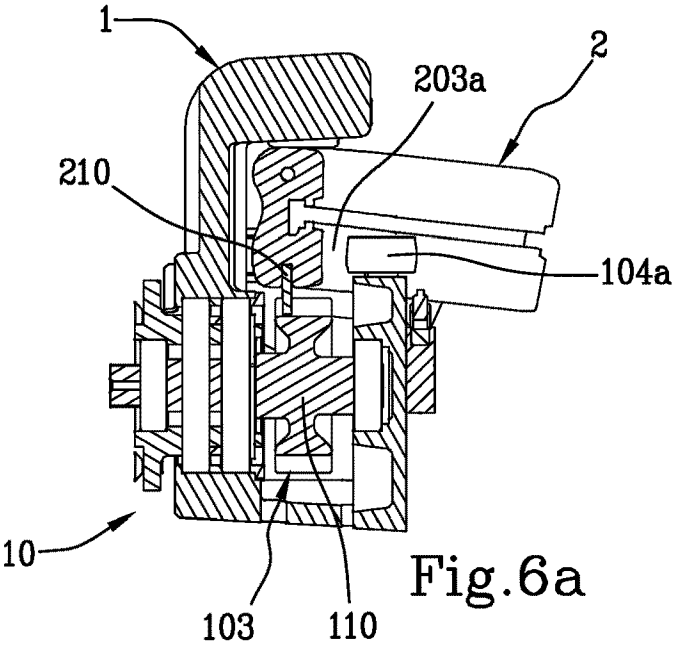
FIG. 6A shows a cross section of the apparatus of FIG. 6 according to the line B-B.
Figure 6:
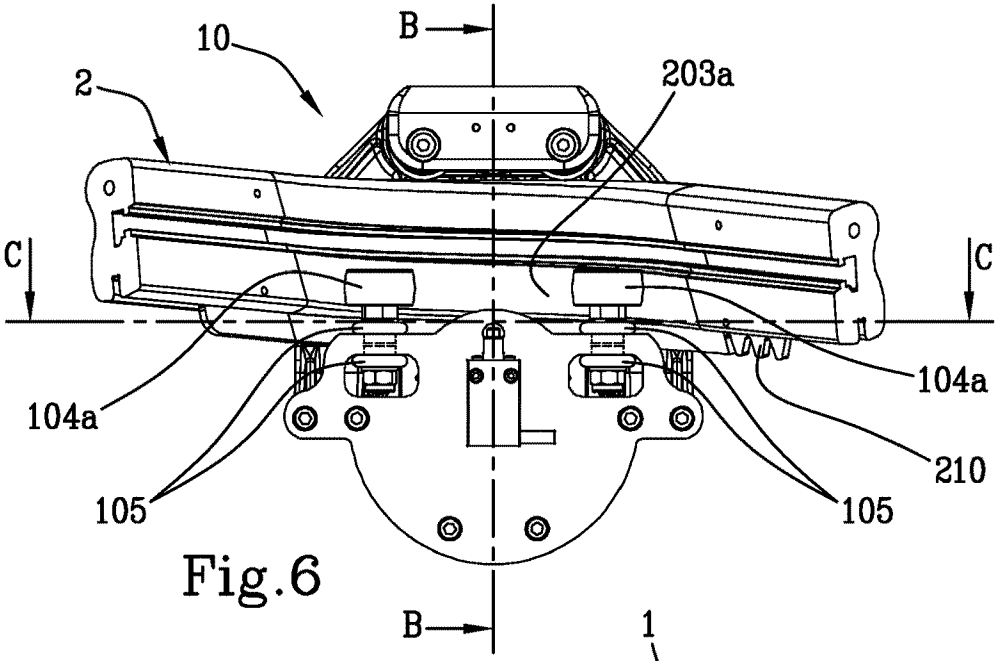
FIG. 6 is a side view of the machine of FIG. 5, in a different operating configuration.

Preferably, the first lower rollers 104*a* are located at a distance from each other less than the distance between the second lower rollers 104*b*. In the embodiment illustrated, the lower rollers 104 are positioned in plan view at respective vertices of an isosceles trapezium (FIG. 3). More specifically, the first lower rollers 104*a* are positioned at the vertices of the smaller base the trapezoidal plan, whilst the second lower rollers 104*b* are positioned at the vertices of the larger base of the above-mentioned trapezoidal plan. Advantageously, this arrangement allows the lower rollers 104 to follow adequately the guide 2 at curves having concavities on the side of first lower rollers 104*a* (FIGS. 6A and 7A).

Preferably, the extensions of the oblique sides of the isosceles trapezium formed in plan view by the lower rollers 104 meet at a distance "D" of between 20 and 30 cm from each first lower roller, preferably the above mentioned distance "D" is between 23 and 27 cm, even more preferably the above-mentioned distance "D" is between 25 and 26 cm, as illustrated in FIG. 3.

Alternatively, it is possible to define the distance "D" in relation to the width of the guide 2, substantially defined, for the purposes of this description, by the minimum distance "Dmin" between the first and second lower rollers 104*a* and 104*b* referred to a same oblique side of the isosceles trapezium described above.

In more detail, "Dmin" is measured in a plane perpendicular to an axis of the first and second lower rollers 104*a* and 104*b*, as shown in FIG. 3.

Preferably, the ratio between the distance "D" and the minimum distance "Dmin" is between 5 and 7.5, preferably between 6.25 and 6.5.

Preferably, an angle "α" formed by the extensions of the oblique sides of the trapezium is between 20° and 40°, even more preferably the above-mentioned angle "α" is between 25° and 33°, even more preferably the above-mentioned angle "α" is between 28° and 30°, as illustrated in FIG. 3.

Preferably, the rollers lower 104 are connected to portions of the frame 101 connected to each other in a rigid fashion, the rigid shape of the frame 101 determines the permanent shape of the isosceles trapezium described above (except for deformation of the elastic elements 105), which does not undergo variations as a function of the shape of the guide 2.

Advantageously, the arrangement of the lower rollers 104 according to what is described above optimises the stability of the carriage 1 for curves from the side of the later support element having a radius of approximately 17 cm or more (FIG. 7), however, this adapts also for the rectilinear or slightly curved stretches on the opposite side.

A sliding support apparatus for a stairlift form a further object of this invention, indicated generically with the numeral 10 in FIGS. 5 to 8.

The apparatus 10 comprises a support guide 2, of the type described above, and a carriage 1, also of the type described above, slidably movable on guide 2. In the apparatus 10, the upper roller 102 of the carriage 1 is engaged in rolling motion on an upper surface of the head portion 201 of the guide 2. The rolling member 103 of the carriage 1 is engaged in rolling motion with a lower surface of the base portion 203 of the guide 2. The first and second lower rollers 104*a*, 104*b* of the carriage 1 are engaged or can be engaged in rolling movement on a respective first and second lateral surface 203*a*, 203*b*, opposite each other, of the base portion 203 of the guide 2.

Preferably, the first lateral surface 203*a* of the base portion 203 of the guide 2 is planar. Preferably, the second lateral surface 203*b* of the base portion 203 of the guide 2 is convex. More specifically, the carriage 1 and the guide 2 are configured in such a way that the lower convex or rounded rollers 104 (in particular, the first lower rollers 104*a*) are engaged in rolling motion on a planar lateral surface of the base portion 203 (in particular, the first lateral surface 203*a*).

Advantageously, the carriage 1 and the guide 2 are configured in such a way that the lower cylindrical rollers 104 (in particular, the second lower rollers 104*b*) are engaged in rolling motion on a convex lateral surface of the base portion 203 (in particular, the second lateral surface 203*b*) in such a way as to have uniform contact with the guide 2 during a sliding of the carriage 1 on the guide 2 wherein the carriage 1 is inclined or misaligned relative to the guide 2, in particular at curved portions of the guide 2 (FIG. 7A).

Preferably, the guide 2 is modular and realised by means of a junction of prefabricated and preconfigured elements. More specifically, the above-mentioned elements comprise rectilinear pieces and curved pieces, which are connected to each other to define a guide which extends along a desired trajectory, in such a way that it can follow a path along or around an architectural obstacle for persons with reduced mobility.

A first embodiment of the sliding support apparatus 10 comprises a carriage 1, wherein the rolling member 103 comprises a pinion 110, according to the first embodiment described above. In this embodiment, the guide 2 comprises a rack 210 connected to the base portion 203 and the pinion 110 is meshed with the rack 210. Preferably, the apparatus 10 also comprises a motor for actuating the pinion 110 moving the carriage 1 along the guide 2.

Figure 4:
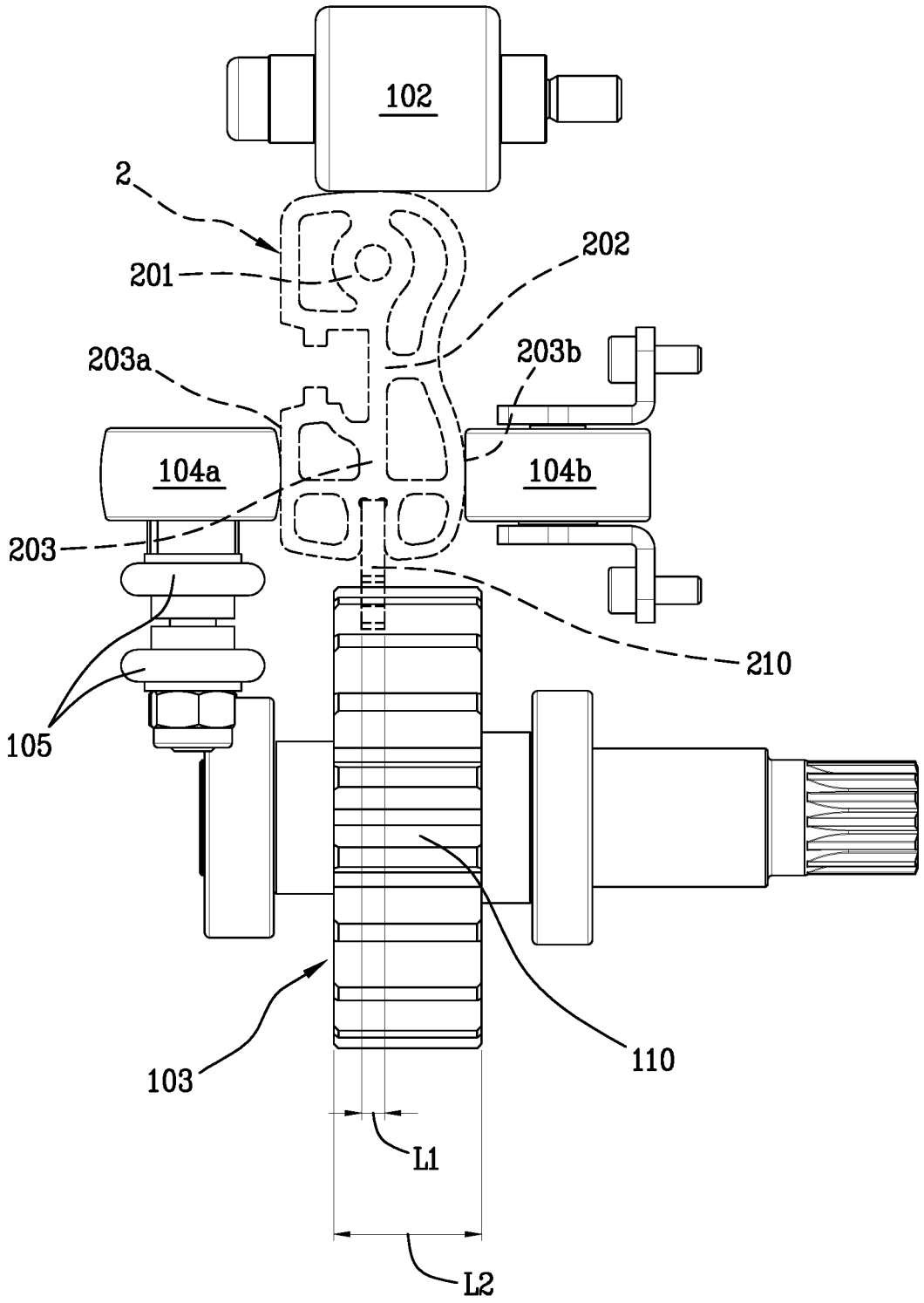
FIG. 4 is a front view of the components of FIG. 2.
Figure 5A:
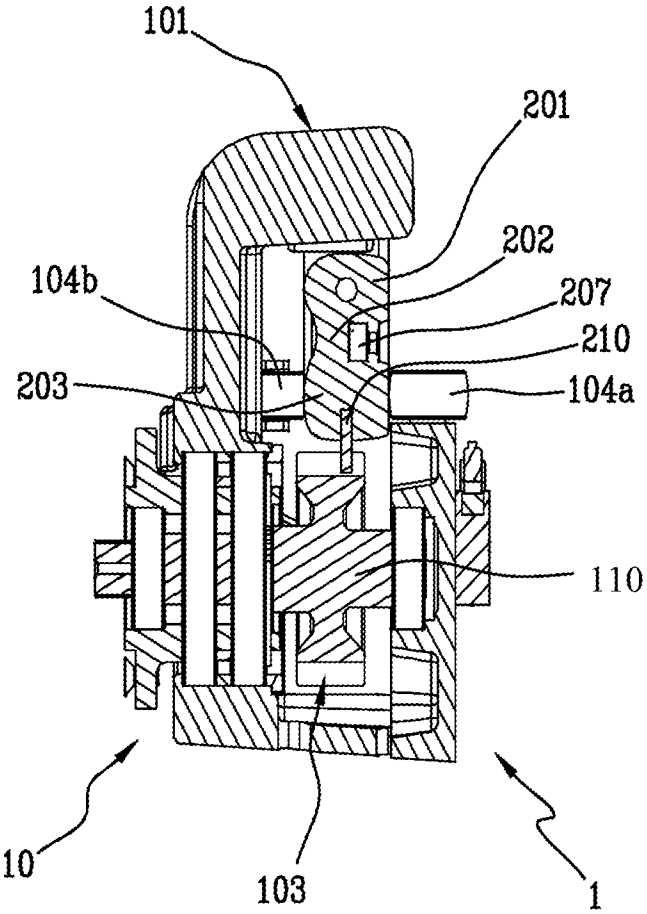
FIG. 5A shows a cross section of the apparatus of FIG. 5 according to the line A-A.
Figure 5:
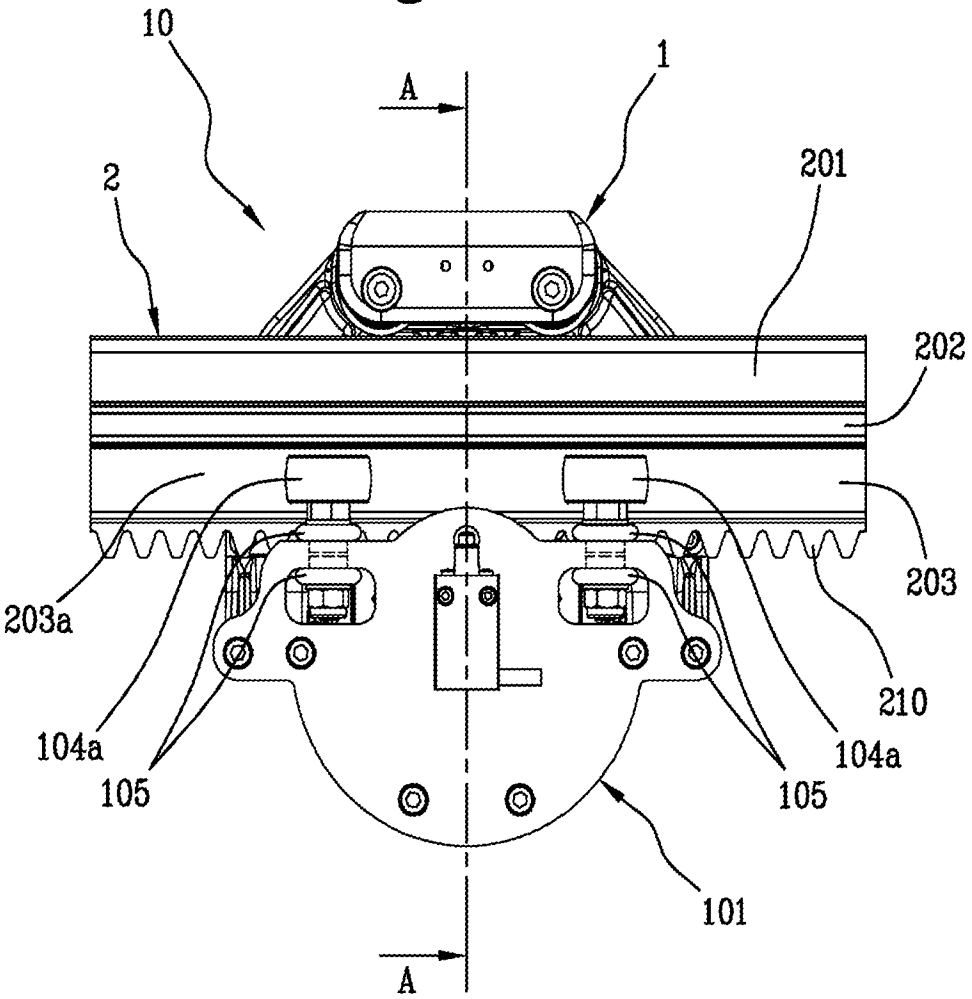
FIG. 5 is a side view of a sliding support apparatus for a stairlift, made in accordance with the present invention.

In the embodiment illustrated, the rack 210 has, in cross section, a width L1 less than the width L2 of the pinion 110 (FIG. 4). Preferably, the width L1 is between 5% and 30% of the width L2, more preferably, the width L1 is between 10% and 25% of the width L2, even more preferably, the width L1 is between 15% and 18% of the width L2.

Preferably, the meshing point between the rack 210 and the pinion 110, in rectilinear stretches of the guide 2, is, in cross section, moved towards the side of the first lower rollers 104*a* (FIG. 4), in particular, the rack 210 meshes the pinion at a distance from the edge of the pinion which is less than 12 mm with respect to the lateral edge from the side of the first lower rollers 104*a* of the above-mentioned pinion 110. More preferably, the distance from the edge of the pinion is between 3 mm and 9 mm, even more preferably between 5 mm and 7 mm.

Advantageously, the apparatus 10 is configured to perform any curve of radius greater than or equal to 15 cm towards the side of the first lower rollers 104*a* and curves of large radius on the opposite side. In particular, the carriage 1 is optimised to perform any curve of radius greater than or equal 17 cm from the side of the first lower rollers 104*a*.

Figure 6B:
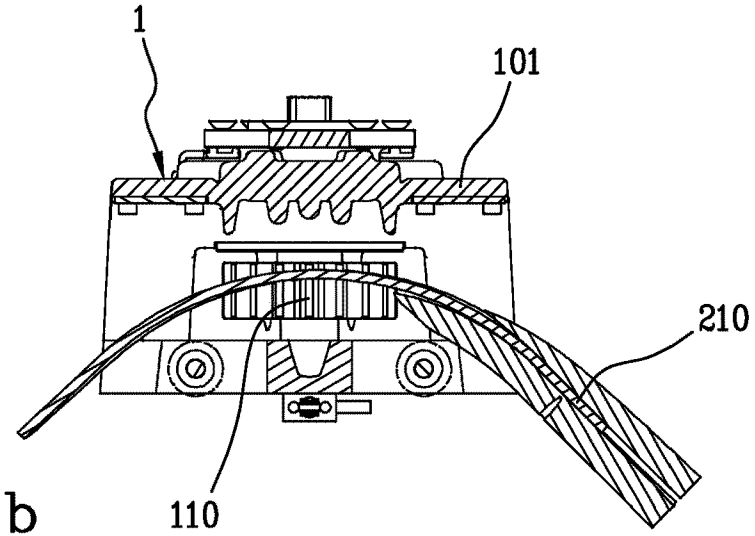
FIG. 6B shows a cross section of the apparatus of FIG. 6 according to the line C-C.

Again advantageously, the meshing between the pinion 110 and the rack 210 configured in this way allows a floating of the pinion on the outer side of the curve without losing the meshing, as shown in FIGS. 6A and 6B.

Preferably, the rack 210 has, at stretches of the guide 2 with a helical curved shape, a chordal thickness of the teeth which is less than the chordal thickness of the teeth in the rectilinear stretches.

Again preferably, the rack 210 has slope change stretches (FIG. 8) wherein the set of teeth is correct for a meshing of the pinion/gear type, in particular in the slope change stretches of the guide 2 the shape of the teeth of the rack 210 is involute.

In a second embodiment, not illustrated and an alternative to the first embodiment, the apparatus 10 comprises a braking unit. More specifically, the apparatus 10 comprises a carriage 1 wherein the rolling member 103 comprises a friction rotor 111, according to the second embodiment described above. Preferably, in this embodiment the guide 2 comprises an insert, installed below the base portion 203 of the guide 2 in place of the rack 210. More specifically, the friction rotor 111 is engaged in rolling motion with the above-mentioned insert and is connected with a safety device 5, to cause a movement of the safety device 5 in a safety condition configured to stop the sliding of the carriage 1 on the guide 2. Advantageously, the safety device moves to the safety condition as a function of the angular speed of the friction rotor 11.

Figure 9:
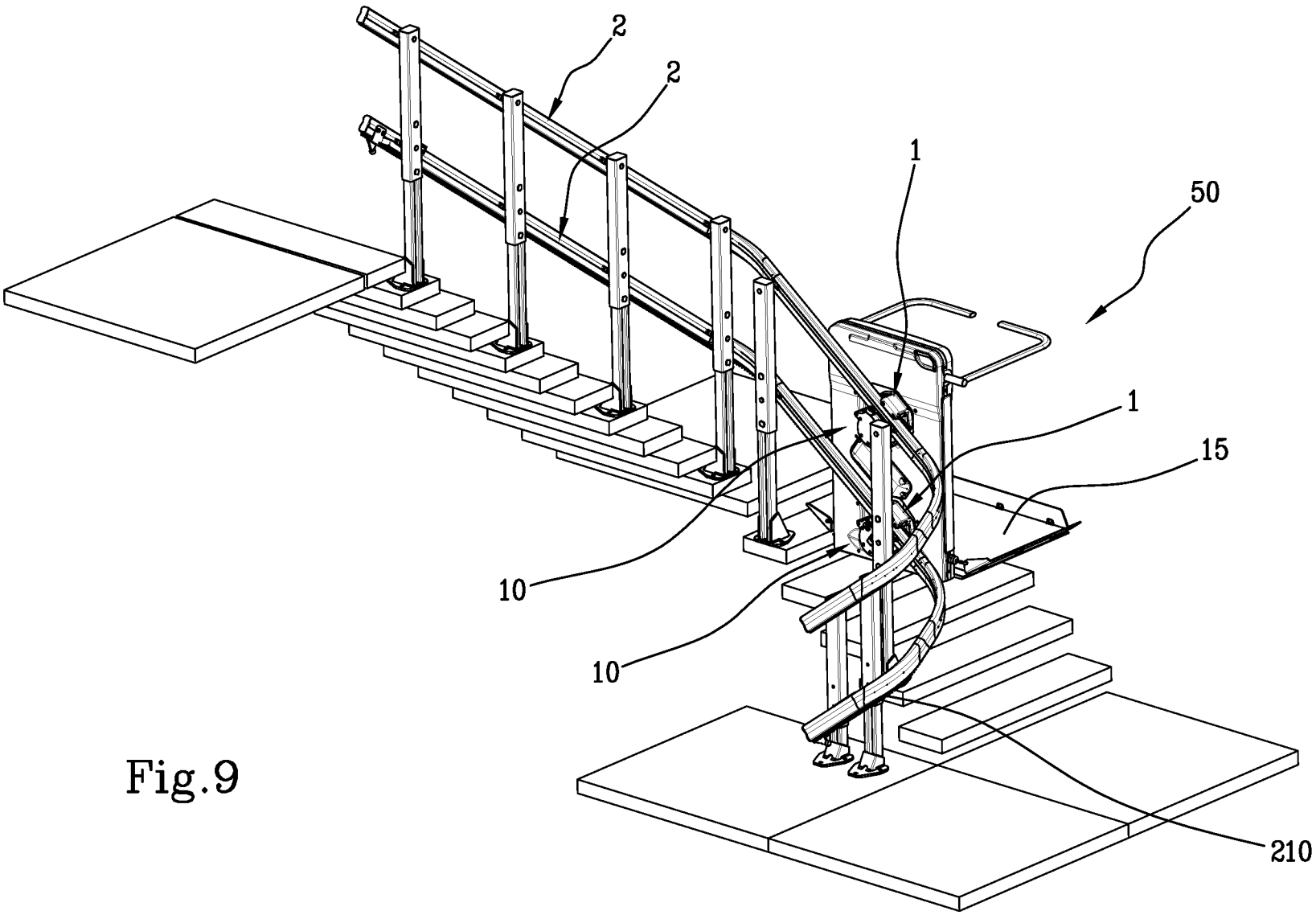
FIG. 9 is a perspective view of a stairlift made in accordance with the present invention.

According to another aspect, the invention relates to a stairlift, labeled 50 in FIG. 9.

The stairlift 50 comprises a loading element 15, a first sliding support apparatus 10 according to the first embodiment described above and a second apparatus 10 for sliding support 10 according to the second embodiment described above.

More specifically, the first apparatus 10 for sliding support 10 comprises a carriage 1 connected to a first portion of the loading element 15. This sliding support apparatus 10 comprises a drive unit comprising the pinion 110, the rack 210 positioned along the respective guide 2 and a relative motor. Preferably, this drive unit is configured to move the loading element 15 along the guides 2, transporting a weight of between 0 kg and 300 kg on the above-mentioned loading element 15.

The second sliding support apparatus 10 comprises a carriage 1 connected to a second portion of the loading element 15. This sliding support apparatus 10 comprises a braking unit comprising a friction rotor 111 and the safety device 5 configured as described above.

According to another aspect, this invention relates to a kit for making a stairlift of the type described above, comprising a loading element 15, a first sliding support apparatus 10 according to the first embodiment described above and a second support apparatus 10 according to the second embodiment described above.

The first sliding support apparatus 10 is similar to that described above for the stairlift 50 and is connected or connectable to a first portion of the loading element 15.

The second sliding support apparatus 10 is similar to that described above for the stairlift 50 and is connected or connectable to a first portion of the loading element 15.

Advantageously, the guide 2 of the first and second sliding support apparatus 10 are modular and comprise a plurality of modules connectable to each other.

More specifically, the guide 2 comprises at least one rectilinear module, having zero curvature.

The guide 2 also comprises at least one inclination change module, provided in a pre-curved configuration according to a radius of curvature which is preferably constant and predetermined. Preferably, the radius of curvature of the inclination change modules is between 50 cm and 150 cm. In the embodiment illustrated the radius of curvature of the inclination change modules is equal to 100 cm.

The guide 2 also comprises at least one spiral curved module, provided in a pre-curved configuration according to a spiral radius of curvature which is preferably constant and predetermined. Preferably, the radius of curvature of the spiral curved modules is between 10 cm and 25 cm. In the embodiment illustrated, the radius of curvature of the spiral curved modules is equal to 17 cm.

Advantageously, in the curved modules of the guide 2 of the first apparatus 10, that is to say, the one comprising the drive unit, the rack 210 is configured and correct relative to the rectilinear case as described above.

The invention achieves the set aim by obviating the drawbacks of the prior art. More specifically, the position of the lower rollers which engage the guide in the vicinity of the pinion increases the stability of the carriage, and therefore its comfort during use, and contributes to maintaining a correct pinion-rack meshing, in particular on curved stretches of the guide.

More in detail, the presence of lower rollers in rolling motion on opposite lateral surfaces of the base portion of the guide is particularly important to prevent mutual twisting between the pinion and the rack which determine the meshing problems encountered in the prior art and in particular in the solution described in patent document WO2005/085116.

Moreover, the rigidity of the frame and the mutual position of the lower rollers determines, in the curved portions of the guide, a controlled lateral translation of the pinion with respect to the portion of the guide engaged by it, in such a way as to not adversely affect the mutual meshing.

The lower rounded rollers engaged in rolling motion on a convex lateral surface of the base portion of the guide and the lower cylindrical rollers engaged in rolling motion on a flat lateral surface of the base portion of the guide improve the adherence of the lower rollers on the guide. In addition, the elastic element which allows a misalignment of the first lower rollers in the curved stretches, in synergy with their rounded shape, improves the adherence of the lower rollers on the guide.

The better adherence of the lower rollers on the guide contributes to maintaining the pinion in the correct position relative to the rack, favouring a correct meshing.

In addition, the trapezoidal arrangement of the lower rollers improves the sliding of the carriage on the guide at predetermined curves on the side of the support, which are narrower and greater in number. This aspect also contributes to maintaining a correct pinion-rack meshing and avoiding the occurrence of excessive forces between the lower rollers and the guide.

Lastly, the design and manufacture of the guide in a modular form allows individual modules to be made wherein the rack has features optimised to the trajectory of the guide, minimising pinion rack meshing errors.

Advantageously, the substantial improvement of the features of the pinion-rack meshing made possible by the measures illustrated substantially reduces the penetration between the respective teeth and meshing errors, allowing materials which are softer to be used in the production of the rack and increasing substantially the service life and the long-term safety of the racks compared with the prior art.

All the aspects described above can be achieved independently from one another.

The invention claimed is:

1. A carriage (1) for a stairlift, configured to slide along a support guide (2) of the type comprising a head portion (201), a base portion (203) and a central portion (202) arranged between the head portion (201) and the base portion (203) and having a fixing portion designed to be fixed to a lateral support element, wherein said carriage (1) comprises:

- a concave shaped frame (101) defining a seat (S) for housing at least a part of said guide (2);
- at least one upper roller (102), mounted on an upper portion (101*a*) of said frame (101) to be rotatably engageable resting on an upper surface of the head portion (201) of said guide (2);
- a rolling member (103), mounted on a lower portion (101*b*) of said frame (101) to be rotatably engageable with a lower surface of said base portion (203) of the guide (2);
- first and second lower rollers (104*a*, 104*b*), mounted on said frame (101) in proximity to said rolling member (103) so that said first and second lower rollers (104*a*, 104*b*) are engaged or can be engaged in rolling movement respectively on a first lateral surface (203*a*) of said base portion (203) and a second lateral surface (203*b*) of said base portion (203), opposite the first;
- wherein said carriage (1) comprises two first lower rollers (104*a*) and two second lower rollers (104*b*), wherein the first lower rollers (104*a*) are located at a distance from each other less than the distance between the second lower rollers (104*b*).

2. The carriage (1) according to claim 1, wherein said first lower rollers (104*a*) are mounted on said lower portion (101*b*) of the frame (101).

3. The carriage (1) according to claim 2, wherein said frame (101) comprises a lateral portion (101*b*) for connecting between said upper portion (101*a*) and said lower portion (101*c*), said second lower rollers (104*b*) being mounted on the lateral portion (101*b*) or on the lower portion (101*b*).

4. The carriage (1) according to claim 3, wherein said first lower rollers (104*a*) and said lateral portion (101*b*) are positioned in opposite positions relative to the housing seat (S).

5. The carriage (1) according to claim 1, wherein said upper roller (102) and said rolling member (103) are mounted on the frame (101) of the carriage (1) in a rotatable fashion about axes of rotation which are parallel to each other.

6. The carriage (1) according to claim 1, wherein each of said first and/or second lower rollers (104*a*, 104*b*) is associated with an elastic element (105) for connecting between the lower roller (104) and the frame (101), a compliance of said elastic element (105) determining a variation of inclination of the axis of rotation of the lower roller (104) relative to the frame (101).

7. The carriage (1) according to claim 1, wherein the first and/or second lower rollers (104*a*, 104*b*) have convex or rounded lateral surfaces.

8. The carriage (1) according to claim 1, wherein the lower rollers (104) are positioned in plan view at respective vertices of an isosceles trapezium.

9. The carriage (1) according to claim 8, wherein said lower rollers (104) are positioned in plan view at respective vertices of the isosceles trapezium in such a way that the extensions of opposite oblique sides of the isosceles trapezium meet at a distance (D) of between 20 cm and 30 cm from the first lower rollers (104*a*).

10. The carriage (1) according to claim 8, wherein the lower rollers (104) are positioned in plan view at respective vertices of the isosceles trapezium in such a way that:

the extensions of opposite oblique sides of the isosceles trapezium meet at a distance (D) from the first lower rollers (104*a*);

the lower rollers (104*a*, 104*b*) referred to a same oblique side of said isosceles trapezium have a mutual minimum distance (Dmin), in a plane perpendicular to an axis of the lower rollers (104*a*, 104*b*), and a ratio between said distance (D) and said minimum distance (Dmin) is between 5 and 7.5.

11. The carriage (1) according to claim 8, wherein the lower rollers (104) are positioned in plan view at respective vertices of the isosceles trapezium in such a way that an angle ($\alpha$) formed between the extensions of opposite oblique sides of the trapezium is between 25° and 33°.

12. The carriage according to claim 8, wherein the frame (101) has rigid configuration, and wherein the lower rollers (104) are applied to portions of said frame (101) rigidly connected to each other.

13. The carriage according to claim 1, wherein the frame (101) has rigid configuration.

14. The carriage (1) according to claim 1, wherein the rolling member (103) comprises a pinion (110) which can be meshed with a rack (210) applied beneath said guide (2).

15. The carriage (1) according to claim 1, wherein said rolling member (103) comprises a friction rotor, connected to a safety device that can be displaced to engage with the guide (2) in a safe condition, blocking the sliding of the carriage (1).

16. The carriage according to claim 1, wherein a vertical distance between each of said first and/or second lower rollers and the rolling member is less than 3 cm.

17. A sliding support apparatus (10) for a stairlift, comprising a support guide (2) and a carriage (1), slidably movable on said support guide (2), wherein said carriage (1) comprises:

a concave shaped frame (101) defining a seat (S) for housing at least a part of said guide (2);

at least one upper roller (102), mounted on an upper portion (101*a*) of said frame (101) to be rotatably engageable resting on an upper surface of the head portion (201) of said guide (2);

a rolling member (103), mounted on a lower portion (101*b*) of said frame (101) to be rotatably engageable with a lower surface of said base portion (203) of the guide (2);

first and second lower rollers (104*a*, 104*b*), mounted on said frame (101) in proximity to said rolling member (103) so that said first and second lower rollers (104*a*, 104*b*) are engaged or can be engaged in rolling movement respectively on a first lateral surface (203*a*) of said base portion (203) and a second lateral surface (203*b*) of said base portion (203), opposite the first;

wherein said guide (2) comprises:

a head portion (201), a base portion (203);

a central portion (202) arranged between the head portion (201) and the base portion (203) and having a fixing portion designed to be fixed to a lateral support element;

wherein the upper roller (102) of said carriage (1) is engaged in rolling movement on an upper surface of said head portion (201) of the guide (2);

wherein the rolling member (103) of said carriage (1) is engaged in rolling movement on a lower surface of said base portion (203) of the guide (2), wherein the first and second lower rollers (104*a*, 104*b*) of said carriage (1) are engaged or can be engaged in rolling movement on a respective first and second lateral surface (203*a*, 203*b*), opposite each other, of said base portion (203) of the guide (2), and wherein said rolling member (103) comprises a friction rotor engaged in rolling movement with said guide (2), connected with a safety device that can be displaced to engage with the guide (2) in a safe condition, blocking the sliding of the carriage (1), said apparatus (10) comprising a braking unit activatable by said friction rotor.

18. The apparatus (10) according to claim 17, wherein the central portion (202) of the guide (2) comprises an engagement seat (207) interposed between the head portion (201) and the base portion (203) and suitably shaped in such a way as to receive one or more fixing elements designed to fix the guide (2) to a lateral support element, the first lower rollers (104*a*) of the carriage (1) being configured to be arranged in position vertically lower than the fixing elements.

19. The apparatus (10) according to claim 17, wherein one of said first and second lateral surfaces (203*a*, 203*b*) of the base portion (203) of the guide (2) is convex and engaged with corresponding lower cylindrical rollers (104) and/or the other of said first and second lateral surface (203*a*, 203*b*) of the base portion (203) of the guide (2) is planar and engaged with corresponding convex or rounded lower rollers (104).

20. The apparatus (10) for a stairlift according to claim 17, wherein said guide (2) is modular and realised by means of a junction of prefabricated and preconfigured elements, said elements comprising rectilinear sections and curved sections, connected to each other to define a guide (2) extending along a desired trajectory.

21. A stairlift (50) comprising:

a loading element (15);

a first sliding support apparatus (10)

a second sliding support apparatus;

wherein the first sliding support apparatus (10) comprises a first support guide (2) and a first carriage (1) connected to a first portion of the loading element (15) and slidably movable on said first support guide (2)

wherein the first support guide (2) comprises a head portion (201), a base portion (203), and a central portion (202) arranged between the head portion (201) and the base portion (203) and having a fixing portion designed to be fixed to a lateral support element, wherein said first carriage (1) comprises:

a concave shaped frame (101) defining a seat (S) for housing at least a part of said first support guide (2);

at least one upper roller (102), mounted on an upper portion (101*a*) of said concave shaped frame (101) to be rotatably engageable resting on an upper surface of the head portion (201) of said first support guide (2);

a rolling member (103), mounted on a lower portion (101*b*) of said concave shaped frame (101) to be rotatably engageable with a lower surface of said base portion (203) of the first support guide (2);

first and second lower rollers (104*a*, 104*b*), mounted on said concave shaped frame (101) in proximity to said rolling member (103) so that said first and second lower rollers (104*a*, 104*b*) are engaged or can be engaged in rolling movement respectively on a first lateral surface (203*a*) of said base portion (203) and a second lateral surface (203*b*) of said base portion (203), opposite the first, wherein the upper roller (102) of said first carriage (1) is engaged in rolling movement on an upper surface of said head portion (201) of the first support guide (2);

wherein the rolling member (103) of said first carriage (1) is engaged in rolling movement on a lower surface of said base portion (203) of the first support guide (2), wherein the first and second lower rollers (104*a*, 104*b*) of said first carriage (1) are engaged or can be engaged in rolling movement on a respective first and second lateral surface (203*a*, 203*b*), opposite each other, of said base portion (203) of the first support guide (2), and wherein the base portion (203*a*) of the first support guide (2) comprises a rack (210), said rolling member (103) comprising a pinion (110) meshed with said rack (210); said first sliding support apparatus (10) being movable along the first support guide (2) by means of a motor mounted on said first sliding support apparatus (10) and activating said pinion (110);

wherein the second sliding support apparatus (10) comprises a second support guide (2) and a second carriage (1) connected to a second portion of the loading element (15) and slidably movable on said second support guide (2)

wherein the second support guide (2) comprises a head portion (201), a base portion (203) and a central portion (202) comprised between the head portion (201) and the base portion (203) and having a fixing portion designed to be fixed to the lateral support element, wherein said second carriage (1) comprises:

a concave shaped frame (101) defining a seat (S) for housing at least a part of said second support guide (2);

at least one upper roller (102), mounted on an upper portion (101*a*) of said concave shaped frame (101) to be rotatably engageable resting on an upper surface of the head portion (201) of said second support guide (2);

a rolling member (103), mounted on a lower portion (101*b*) of said frame (101) to be rotatably engageable with a lower surface of said base portion (203) of the second support guide (2);

first and second lower rollers (104*a*, 104*b*), mounted on said concave shaped frame (101) in proximity to said rolling member (103) so that said first and second lower rollers (104*a*, 104*b*) are engaged or can be engaged in rolling movement respectively on a first lateral surface (203*a*) of said base portion (203) and a second lateral surface (203*b*) of said base portion (203), opposite the first;

wherein the upper roller (102) of said second carriage (1) is engaged in rolling movement on an upper surface of said head portion (201) of the second support guide (2);

wherein the rolling member (103) of said second carriage (1) is engaged in rolling movement on a lower surface of said base portion (203) of the second support guide (2), and wherein the first and second lower rollers (104*a*, 104*b*) of said second carriage (1) are engaged or can be engaged in rolling movement on a respective first and second lateral surface (203*a*, 203*b*), opposite each other, of said base portion (203) of the second support guide (2);

wherein said rolling member (103) of the second carriage (1) comprises a friction rotor engaged in rolling movement with said second support guide (2), connected with a safety device that can be displaced to engage with the second support guide (2) in a safe condition, blocking the sliding of the second carriage (1), said second sliding support apparatus (10) comprising a braking unit activatable by said friction rotor.

22. A kit for making a stairlift, comprising a loading element (15);

a first sliding support apparatus (10), connected or connectible to a first portion of the loading element (15);

a second sliding support apparatus (10), connected or connectible to a second portion of the loading element (15);

wherein said first sliding support apparatus comprises a first support guide (2) and a first carriage (1), slidably movable on said first support guide (2), and said second sliding support apparatus comprises a second support guide (2) and a second carriage (1), slidably movable on said second support guide (2);

wherein said first and second support guides (2) of the first and second sliding support apparatus (10) are modular and comprise a plurality of modules which can be connected to each other, said plurality of modules comprising:

at least one rectilinear module, having zero curvature, at least one inclination change module, provided in a pre-curved configuration according to a predetermined radius of curvature, at least one spiral curved module, provided in a pre-curved configuration according to a constant and predetermined spiral radius of curvature;

wherein the first support guide (2) of the first sliding support apparatus comprises a head portion (201), a base portion (203) and a central portion (202) arranged between the head portion (201) and the base portion (203) and having a fixing portion designed to be fixed to a lateral support element, wherein said first carriage (1) comprises:

a concave shaped frame (101) defining a seat (S) for housing at least a part of said first support guide (2);

at least one upper roller (102), mounted on an upper portion (101*a*) of said frame (101) to be rotatably engageable resting on an upper surface of the head portion (201) of said first support guide (2);

a rolling member (103), mounted on a lower portion (101*b*) of said frame (101) to be rotatably engageable with a lower surface of said base portion (203) of said first support guide (2);

first and second lower rollers (104*a*, 104*b*), mounted on said frame (101) in proximity to said rolling member (103) so that said first and second lower rollers (104*a*, 104*b*) are engaged or can be engaged in rolling movement respectively on a first lateral surface (203*a*) of said base portion (203) and a second lateral surface (203*b*) of said base portion (203), opposite the first;

wherein the upper roller (102) of said first carriage (1) is engaged in rolling movement on an upper surface of said head portion (201) of the first support guide (2);

wherein the rolling member (103) of said first carriage (1) is engaged in rolling movement on a lower surface of said base portion (203) of the first support guide (2);

wherein the first and second lower rollers (104*a*, 104*b*) of said first carriage (1) are engaged or can be engaged in rolling movement on a respective first and second lateral surface (203*a*, 203*b*), opposite each other, of said base portion (203) of the first support guide (2), and wherein the base portion (203*a*) of the first support guide (2) comprises a rack (210), said rolling member (103) comprising a pinion (110) meshed with said rack (210); said apparatus (10) being movable along the first support guide (2) by means of a motor mounted on said apparatus (10) and activating said pinion (110);

the second sliding support apparatus (10) comprising a second support guide (2) and a second carriage (1) slidably movable on said second support guide (2), the second carriage (1) configured to slide along a second support guide (2) of the type comprising a head portion (201), a base portion (203) and a central portion (202) comprised between the head portion (201) and the base portion (203) and configured for fixing to a lateral support element, wherein said second carriage (1) comprises:

a concave shaped frame (101) defining a seat (S) for housing at least a part of said second support guide (2);

at least one upper roller (102), mounted on an upper portion (101*a*) of said frame (101) to be rotatably engageable resting on an upper surface of the head portion (201) of said second support guide (2);

a rolling member (103), mounted on a lower portion (101*b*) of said frame (101) to be rotatably engageable with a lower surface of said base portion (203) of the second support guide (2);

first and second lower rollers (104*a*, 104*b*), mounted on said frame (101) in proximity to said rolling member (103) so that said first and second lower rollers (104*a*, 104*b*) are engaged or can be engaged in rolling movement respectively on a first lateral surface (203*a*) of said base portion (203) and a second lateral surface (203*b*) of said base portion (203), opposite the first;

wherein the upper roller (102) of said second carriage (1) is engaged in rolling movement on an upper surface of said head portion (201) of the second support guide (2);

wherein the rolling member (103) of said second carriage (1) is engaged in rolling movement on a lower surface of said base portion (203) of the second support guide (2), and wherein the first and second lower rollers (104*a*, 104*b*) of said second carriage (1) are engaged or can be engaged in rolling movement on a respective first and second lateral surface (203*a*, 203*b*), opposite each other, of said base portion (203) of the second support guide (2), wherein said rolling member (103) comprises a friction rotor engaged in rolling movement with said second support guide (2), connected with a safety device that can be displaced to engage with the second support guide (2) in a safe condition, blocking the sliding of the second carriage (1), said apparatus (10) comprising a braking unit activatable by said friction rotor.

23. A carriage (1) for a stairlift, configured to slide along a support guide (2) of the type comprising a head portion (201), a base portion (203) and a central portion (202) arranged between the head portion (201) and the base portion (203) and configured for fixing to a lateral support element, wherein said carriage (1) comprises:

a concave shaped frame (101) defining a seat (S) for housing at least a part of said guide (2);

at least one upper roller (102), mounted on an upper portion (101*a*) of said frame (101) to be rotatably engageable resting on an upper surface of the head portion (201) of said guide (2);

a rolling member (103), mounted on a lower portion (101*b*) of said frame (101) to be rotatably engageable with a lower surface of said base portion (203) of the guide (2);

first and second lower rollers (104*a*, 104*b*), mounted on said frame (101) in proximity to said rolling member (103) so that said first and second lower rollers (104*a*, 104*b*) are engaged or can be engaged in rolling movement respectively on a first lateral surface (203*a*) of said base portion (203) and a second lateral surface (203*b*) of said base portion (203), opposite the first, wherein each of said first and/or second lower rollers (104*a*, 104*b*) is associated with an elastic element (105) for connecting between the lower roller (104) and the frame (101), a compliance of said elastic element (105) determining a variation of inclination of the axis of rotation of the lower roller (104) relative to the frame (101).

24. A carriage (1) for a stairlift, configured to slide along a support guide (2) of the type comprising a head portion (201), a base portion (203) and a central portion (202) arranged between the head portion (201) and the base portion (203) and configured for fixing to a lateral support element, wherein said carriage (1) comprises:

a concave shaped frame (101) defining a seat (S) for housing at least a part of said guide (2);

at least one upper roller (102), mounted on an upper portion (101*a*) of said frame (101) to be rotatably engageable resting on an upper surface of the head portion (201) of said guide (2);

a rolling member (103), mounted on a lower portion (101*b*) of said frame (101) to be rotatably engageable with a lower surface of said base portion (203) of the guide (2);

first and second lower rollers (104*a*, 104*b*), mounted on said frame (101) in proximity to said rolling member (103) so that said first and second lower rollers (104*a*, 104*b*) are engaged or can be engaged in rolling movement respectively on a first lateral surface (203*a*) of said base portion (203) and a second lateral surface (203*b*) of said base portion (203), opposite the first, wherein said rolling member (103) comprises a friction rotor, connected to a safety device that can be displaced to engage with the guide (2) in a safe condition, blocking the sliding of the carriage (1).

* * * * *